US006335699B1

(12) United States Patent
Honma

(10) Patent No.: US 6,335,699 B1
(45) Date of Patent: Jan. 1, 2002

(54) RADOME

(75) Inventor: Shinichi Honma, Toyko (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/531,324

(22) Filed: Mar. 20, 2000

(30) Foreign Application Priority Data

Oct. 18, 1999 (JP) ..... 11-295499

(51) Int. Cl.[7] ..... H01Q 1/42

(52) U.S. Cl. ..... 342/4; 342/13; 342/5; 343/872

(58) Field of Search ..... 342/1, 2, 3, 4, 342/5, 6, 11, 13; 343/872

(56) References Cited

U.S. PATENT DOCUMENTS 5,600,325 A * 2/1997 Whelan et al. ..... 342/13
5,949,387 A * 9/1999 Wu et al. ..... 343/909
6,028,565 A * 2/2000 Mackenzie et al. ..... 343/872
6,232,931 B1 * 5/2001 Hart ..... 343/909

OTHER PUBLICATIONS

"About Radome" Mitsubishi Denki Giho, vol. 29, No. 7, 1955.

* cited by examiner

*Primary Examiner*—John B. Sotomayor
(74) *Attorney, Agent, or Firm*—Sughrue Mion, PLLC

(57) ABSTRACT

A radome includes a liquid crystal layer, and control electrode layers and a power source for applying an electric field to the liquid crystal layer. The permittivity of the liquid crystal layer changes when an electric field is applied from the power source through the control electrode layers. Thickness and relative permittivity are selected to permit radio waves having the working frequency of a radar antenna to pass through during application of the electric field.

8 Claims, 7 Drawing Sheets

RADOME

BACKGROUND OF THE INVENTION

1. Field of the Invention

The present invention relates to a radome for protecting a radar antenna, for example.

2. Description of the Related Art

Generally, when a radar antenna is mounted to an aircraft, the antenna is placed inside a radome. When a radar antenna is mounted on a ship or on the ground, the antenna is also covered by a radome to protect against wind and subsequently smooth rotation of the antenna and to prevent reduction of electrical performance of the antenna due to adhesion of raindrops.

This kind of assembly is described in detail in "Redoomu ni tsuite" ("Radome-Antenna Housing") by Takashi KITSUREGAWA, Mitsubishi Denki Gijutsu Hohkoku (Mitsubishi Electric Technical Reports), Vol. 29, No. 7, pp. 73–79, 1955.

FIGS. 12 and 13 are a perspective and a cross section, respectively, schematically showing a conventional radar assembly employing a radome.

In FIGS. 12 and 13, a radome 1 is called a half-wavelength plate radome, and is composed of a dielectric plate. A radar antenna 2 functioning as a radar device is disposed inside the radome 1. Reinforced plastics such as Fiber Reinforced Plastics (FRPs), polypropylene, or engineering plastics such as ABS resin, are used in the radome 1.

In consideration of the relative permittivity and dielectric dissipation factor of the dielectric material, this radome 1 is designed to permit passage of radio waves having a frequency used by the radar antenna 2 with minimal loss, in other words, reflection by the dielectric plate composing the radome 1 is reduced.

If we let $\lambda_0$ be the free space wavelength of the working radio wave, let $\in_r$ be the relative permittivity of the dielectric material used, and let $\theta_{in}$ be the angle of incidence of radio waves relative to the radome, then the thickness d of the dielectric plate composing the radome 1 is represented by Expression (1) below.

$$d=(N\lambda_0)/\{2(\in_r-\sin^2\theta_{in})^{1/2}\} \quad (1)$$

Moreover, N is a natural number, called the radome order.

Now, by making the radome 1 (dielectric plate) a thickness d which satisfies Expression (1), reflection by the radome 1 (dielectric plate) is reduced, permitting passage of radio waves having the frequency used by the radar antenna 2 with minimal loss.

The relationship between the radio wave frequency f, its free space wavelength $\lambda$, and the speed of light c is given by Expression (2).

$$\lambda=c/f \quad (2)$$

Because a conventional radome 1 is constructed in the above manner, radio waves having a frequency which permits passage with minimal loss are constricted to radio waves having the working frequency of the radar antenna 2. Thus, one problem has been that when the radar antenna 2 is not being used, external radio waves having the same frequency as the working frequency of the radar antenna 2 also pass through with minimal loss, interfering with the radar antenna 2 and giving rise to malfunctions.

SUMMARY OF THE INVENTION

The present invention aims to solve the above problems and an object of the present invention is to provide a radome enabling interference in a radar device due to external radio waves to be reduced by enabling passage of radio waves having a frequency used by the radar device to be controlled and by preventing penetration by external radio waves having the same frequency as the radio waves used by the radar device when the radar device is not being used.

In order to achieve the above object, according to one aspect of the present invention, there is provided a radome which has a dielectric layer whose relative permittivity is changed by the application of an electric field, and an electric field applying means for applying the electric field to the dielectric layer.

DETAILED DESCRIPTION OF THE PREFERRED EMBODIMENTS

The preferred embodiments of the present invention will now be explained with reference to the drawings.

Embodiment 1

Figure 1:
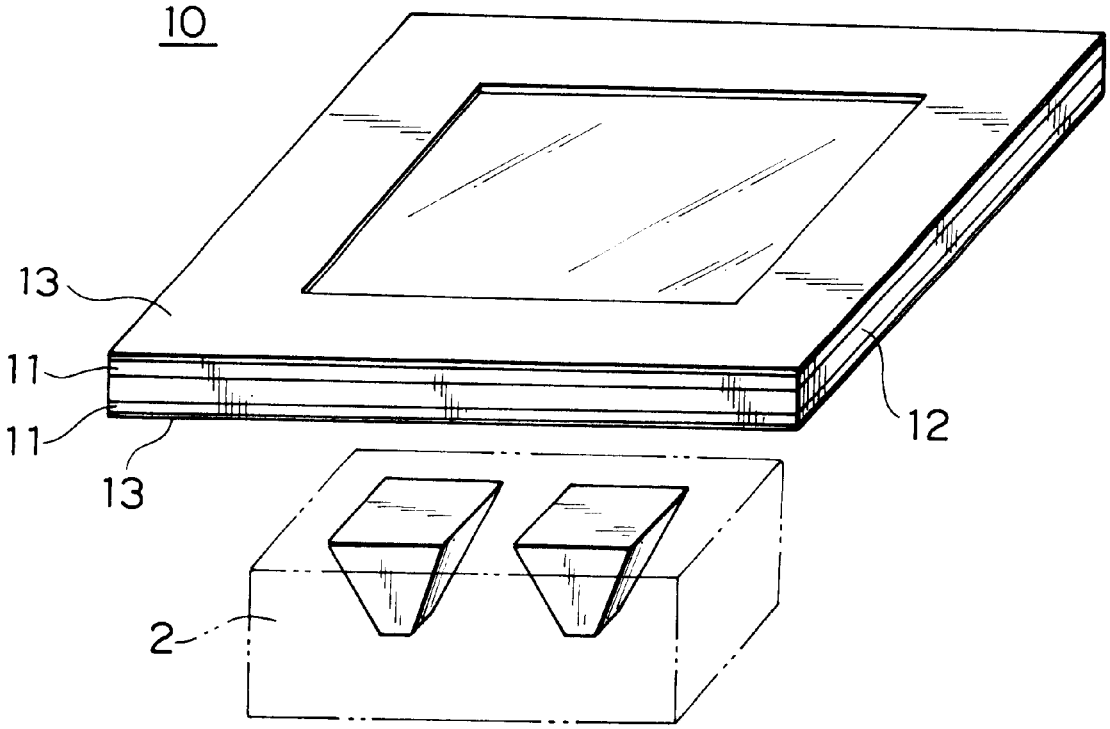
FIG. 1 is a perspective schematically showing a radar assembly employing a radome according to Embodiment 1 of the present invention.
Figure 2:
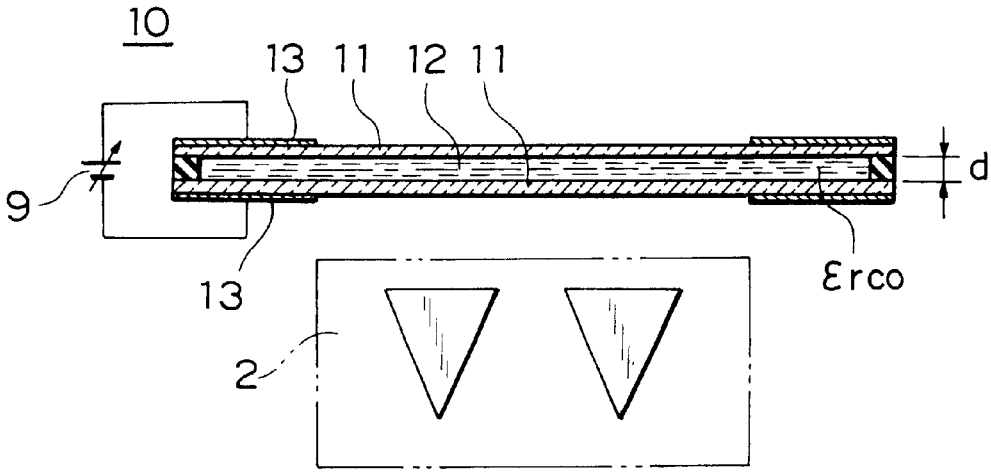
FIG. 2 is cross section schematically showing a radar assembly employing a radome according to Embodiment 1 of the present invention.

FIGS. 1 and 2 are a perspective and a cross section, respectively, schematically showing a radar assembly employing a radome according to Embodiment 1 of the present invention.

In FIGS. 1 and 2, the radome 10 includes: a pair of glass plates 11 disposed with a predetermined spacing relative to each other; a liquid crystal layer 12 functioning as a dielectric layer composed of low-molecular-weight liquid crystals sealed hermetically between the pair of glass plates 11; and control electrode layers 13 composed of metal electrodes each formed in a frame shape and disposed on an upper and a lower surface of the pair of glass plates 11, respectively. In use, this radome is disposed so as to cover a radar antenna 2 functioning as a radar device. Here, an electric field applying means is composed of a power source 9 and the control electrode layers 13.

In this radome 10, voltage is applied between the pair of control electrode layers 13 by the power source 9, and the permittivity of the liquid crystal layer 12 changes when an electric field arises between the control electrode layers 13. Here, the state in which voltage is being applied between the control electrode layers 13 and an electric field is present in the control electrode layers 13 is called the "controlled state" of the liquid crystal layer, and the state in which voltage is not being applied between the control electrode layers 13 and an electric field is not present in the control electrode layers 13 is called the "non-controlled state" of the liquid crystal layer. Let $\in_{rco}$ be the relative permittivity of the liquid crystal layer in the controlled state, and let $\in_{rnc}$ be the relative permittivity of the liquid crystal layer in the non-controlled state. Let $f_0$ be the radio wave frequency used in the radar antenna 2, and $\lambda_0$ be the free space wavelength thereof.

The liquid crystal layer 12 of the radome 10 is selected to have a thickness d which satisfies the above Expression (1) in the controlled state, that is, when $\in_r=\in_{rco}$. In other words, in the controlled state of the liquid crystal layer 12, reflection by the radome 10 of radio waves having a frequency $f_0$ is reduced, permitting passage of radio waves having the frequency used by the radar antenna 2 with minimal loss. Moreover, the relative permittivity of the liquid crystal layer 12 is controlled by the magnitude of the applied electric field and by the liquid crystal material.

In a radome 10 constructed in this manner, when the radar antenna 2 is being used, voltage is applied between the control electrode layers 13 using the power source 9, and the liquid crystal layer is in the controlled state. At that time, the relative permittivity of the liquid crystal layer 12 is $\in_{rco}$, and radio waves having the working frequency of the radar antenna 2 can pass through the region of the liquid crystal layer surrounded by the control electrode layers 13 of the radome 10 with minimal loss. Thus, the radar antenna 2 can transmit and receive signals without hindrance.

On the other hand, when the radar antenna 2 is not being used, voltage application between the control electrode layers 13 is terminated, and the liquid crystal layer is in the non-controlled state. At that time, the relative permittivity of the liquid crystal layer 12 is $\in_{rcn}$, and radio waves having the working frequency of the radar antenna 2 cannot pass through the region of the liquid crystal layer surrounded by the control electrode layers 13 of the radome 10. Thus, even if external radio waves having the same frequency as the working frequency arrive, the external radio waves are blocked by the radome 10 and prevented from reaching the radar antenna 2. Consequently, interference in the radar antenna 2 due to the arrival of external radio waves is reduced, enabling the occurrence of malfunctions to be suppressed.

In this manner, according to Embodiment 1, because the liquid crystal layer 12 functioning as a dielectric layer is held between the pair of glass plates 11, and the control electrode layers 13 are disposed on an upper and a lower surface of the pair of glass plates 11, respectively, the permittivity of the liquid crystal layer 12 can be changed by applying a voltage between the control electrode layers 13. Thus, if the thickness and relative permittivity of the liquid crystal layer 12 are selected to permit passage of radio waves having the working frequency of the radar antenna 2 when the liquid crystal layer is in the controlled state, then by synchronizing the controlled state of the liquid crystal layer with the operation of the radar antenna 2, radio waves having the working frequency can pass through the radome 10 with minimal loss and the radar antenna 2 can transmit and receive signals without hindrance when the radar antenna 2 is being used, and penetration by external radio waves having the same frequency as the working frequency can be blocked when the radar antenna 2 is not being used, enabling interference in the radar antenna 2 due to external radio waves to be reduced.

Embodiment 2

In Embodiment 1, the liquid crystal layer 12 of the radome 10 is selected to have a thickness d satisfying Expression (1) above in the controlled state, that is, when $\in_r=\in_{rco}$, but in Embodiment 2, the liquid crystal layer 12 of the radome 10 is selected to have a thickness d satisfying Expression (1) above in the non-controlled state, that is, when $\in_r=\in_{rnc}$.

In Embodiment 2, by making the non-controlled state of the liquid crystal layer 12 when the radar antenna 2 is being used, radio waves having the working frequency of the radar antenna 2 can pass through the region of the liquid crystal layer 12 surrounded by the control electrode layers 13 of the radome 10 with minimal loss. Thus, the radar antenna 2 can transmit and receive signals without hindrance.

On the other hand, by applying voltage between the control electrode layers 13 and making the controlled state of the liquid crystal layer when the radar antenna 2 is not being used, radio waves having the working frequency of the radar antenna 2 cannot pass through the region of the liquid crystal layer surrounded by the control electrode layers 13 of the radome 10. Thus, even if external radio waves having the same frequency as the working frequency arrive, the external radio waves are blocked by the radome 10 and prevented from reaching the radar antenna 2.

Consequently, the same effects are achieved in Embodiment 2 as in Embodiment 1 above.

Moreover, in Embodiments 1 and 2 above, the relative permittivity and thickness of the liquid crystal layer 12 are selected to prevent passage of external radio waves having the same frequency as the working frequency of the radar antenna 2, but in uses requiring the reduction of interference in the radar antenna 2 relative to external radio waves having a specific frequency other than the working frequency of the radar antenna 2, the relative permittivity and thickness of the liquid crystal layer 12 may also be selected to reduce the penetration of external radio waves having that specific frequency.

Embodiment 3

Figure 3:
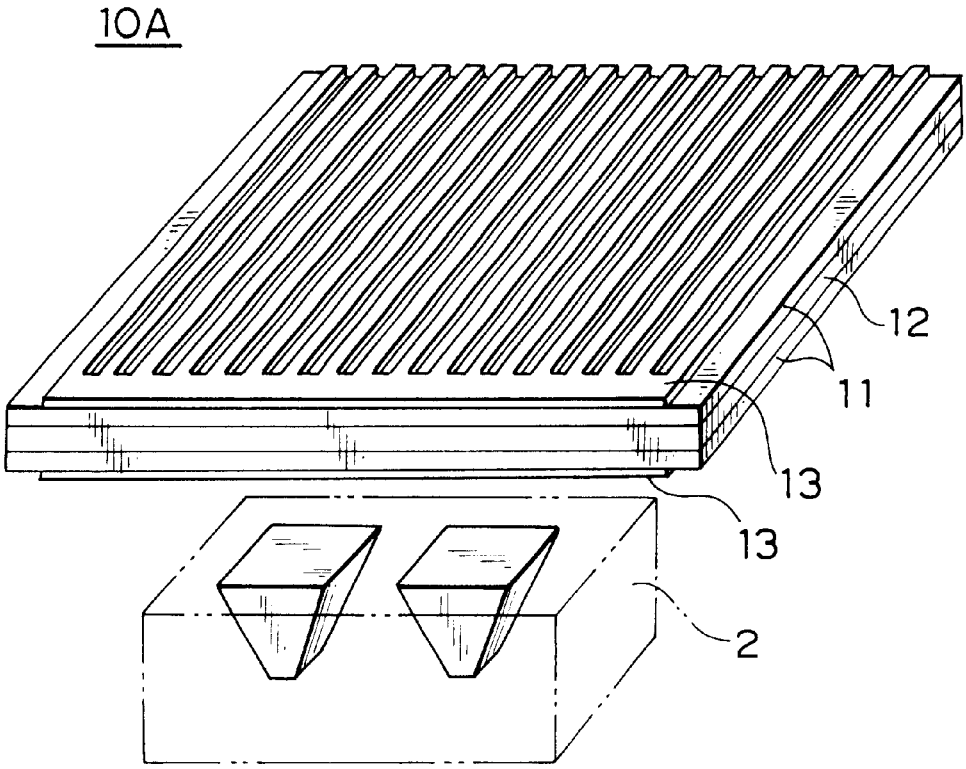
FIG. 3 is a perspective schematically showing a radar assembly employing a radome according to Embodiment 3 of the present invention.

As shown in FIG. 3, in Embodiment 3, the control electrode layers 13 of a radome 10A are formed in a grid shape on two surfaces of the pair of glass plates 11. Moreover, the rest of the construction is the same as in Embodiment 1 above.

In Embodiment 3, because the control electrode layers 13 are formed in a grid shape, radio waves having polarity at right angles to a longitudinal direction of the grid can pass through the control electrode layers 13, achieving the same effects as in Embodiment 1.

Embodiment 4

Figure 4:
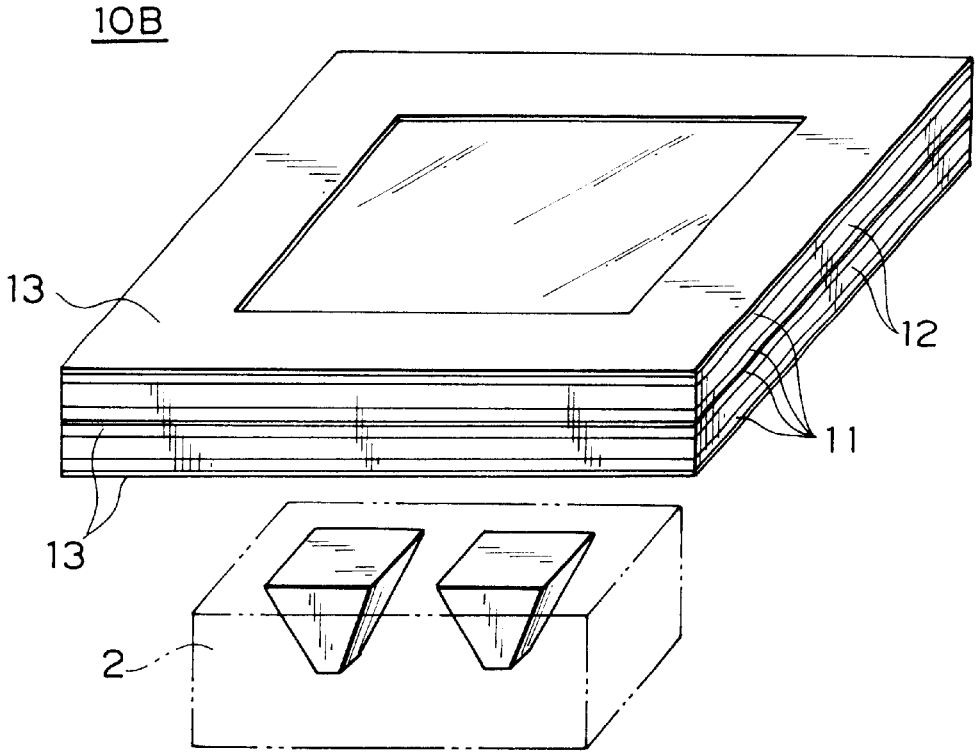
FIG. 4 is a perspective schematically showing a radar assembly employing a radome according to Embodiment 4 of the present invention.
Figure 5:
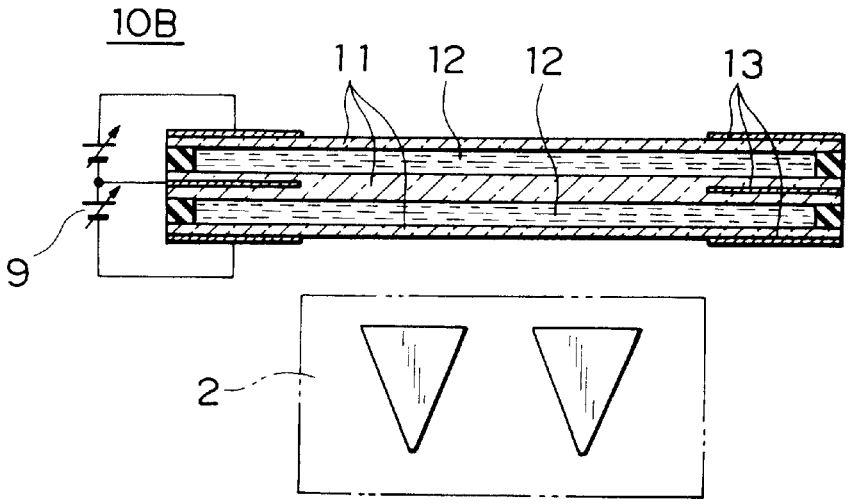
FIG. 5 is a cross section schematically showing a radar assembly employing a radome according to Embodiment 4 of the present invention.

FIGS. 4 and 5 are a perspective and a cross section, respectively, schematically showing a radar assembly employing a radome according to Embodiment 4 of the present invention.

In FIGS. 4 and 5, a radome 10B includes two liquid crystal layers 12 stacked in a thickness direction. One of the liquid crystal layers 12 is selected to have a thickness and relative permittivity satisfying Expression (1) above relative to radio waves having a frequency $f_1$ in the controlled state, and the other liquid crystal layer 12 is selected to have a thickness and relative permittivity satisfying Expression (3) below relative to radio waves having a frequency $f_2$ in the controlled state. As described below, $f_1$ and $f_2$ are chosen to be frequencies close to $f_0$ so that superposed penetration characteristics are not lost. Moreover, the rest of the construction is the same as in Embodiment 1 above.

Now, when radio waves of free space wavelength $\lambda_0$ arrive at a dielectric layer of relative permittivity $\in_r$ at an angle of incidence $\theta_{in}$, the thickness d of the dielectric layer minimizing reflection of those radio waves is calculated by Expression (1) above. When radio waves of free space wavelength $\lambda_0$ arrive at a dielectric layer of relative permittivity $\in_r$ at an angle of incidence $\theta_{in}$, the thickness d of the dielectric layer maximizing reflection of those radio waves is calculated by Expression (3) below.

$$d=(N\lambda_0)/\{4(\in_r-\sin^2\theta_{in})^{1/2}\} \quad (3)$$

Moreover, N is an odd number.

In this radome 10B, at one of the liquid crystal layers 12, reflection of radio waves having the frequency $f_1$ which is slightly offset from the frequency $f_0$ of the radio waves used by the radar antenna 2, that is, reflection of radio waves of a free space wavelength $\lambda_1$ is reduced in the controlled state, and radio waves having the frequency $f_1$ can pass through with minimal loss. On the other hand, at the other liquid crystal layer 12, reflection of radio waves having the frequency $f_2$ which is slightly offset from the frequency $f_0$ of the radio waves used by the radar antenna 2, that is, reflection of radio waves of a free space wavelength $\lambda_2$ is increased in the controlled state, and radio waves having the frequency $f_2$ cannot pass through.

In a radome 10B constructed in this manner, when the radar antenna 2 is being used, voltage is applied between the control electrode layers 13 using the power source 9, and the two liquid crystal layers 12 are in the controlled state. At that time, one of the liquid crystal layers 12 is in a state in which radio waves having the frequency $f_1$ can pass through with minimal loss, and the other liquid crystal layer 12 is in a state in which radio waves having the frequency $f_2$ cannot pass through. Thus, the radio wave penetration characteristics of the radome 10B are the superposed radio wave penetration characteristics of the two liquid crystal layers 12, and only an extremely narrow range of wavelengths centered on the free space wavelength $\lambda_0$ can pass through. Consequently, radio waves having the working frequency of the radar antenna 2 can pass through the region of the liquid crystal layers 12 surrounded by the control electrode layers 13 of the radome 10B with minimal loss, and the radar antenna 2 can transmit and receive signals without hindrance.

On the other hand, when the radar antenna 2 is not being used, voltage application between the control electrode layers 13 is terminated, and the two liquid crystal layers 12 are in the non-controlled state. At that time, both liquid crystal layers 12 are in a state in which radio waves having the working frequency of the radar antenna 2 cannot pass through the region of the liquid crystal layer surrounded by the control electrode layers 13 of the radome 10B. Thus, even if external radio waves having the same frequency as the working frequency arrive, the external radio waves are blocked by the radome 10B and prevented from reaching the radar antenna 2. Consequently, interference in the radar antenna 2 due to the arrival of external radio waves is reduced, enabling the occurrence of malfunctions to be suppressed.

In this manner, the same effects can be achieved in Embodiment 4 as in Embodiment 1 above.

Furthermore, in Embodiment 4, because the two liquid crystal layers 12 are stacked in the thickness direction, by selecting the thickness and relative permittivity of one of the liquid crystal layers 12 in the controlled state so that radio waves having the frequency $f_1$ can pass through with minimal loss and selecting the thickness and relative permittivity of the other liquid crystal layer 12 in the controlled state so that radio waves having the frequency $f_2$ cannot pass through, radio wave penetration characteristics having a sharp peak centered on the frequency $f_0$ can be achieved. Thus, when the radar antenna 2 is being used, passage of external radio waves in the vicinity of the frequency $f_0$ used by the radar antenna 2 can also be reduced, enabling interference in the radar antenna 2 due to external radio waves to be suppressed.

By sharing the control electrode layer 13 disposed between the liquid crystal layers 12, the control electrode layers 13 can be reduced to three layers.

Moreover, in Embodiment 4 above, the thickness and relative permittivity of one of the liquid crystal layers 12 in the controlled state are selected so that radio waves having the frequency $f_1$ can pass through with minimal loss, and the thickness and relative permittivity of the other liquid crystal layer 12 in the controlled state are selected so that radio waves having the frequency $f_2$ cannot pass through. However, the thickness and relative permittivity of one of the liquid crystal layers 12 in the non-controlled state may be selected so that radio waves having the frequency $f_1$ can pass through with minimal loss, the thickness and relative permittivity of the other liquid crystal layer 12 in the non-controlled state being selected so that radio waves having the frequency $f_2$ cannot pass through. Or, the thickness and relative permittivity of one of the liquid crystal layers 12 in the controlled state may be selected so that radio waves having the frequency $f_1$ can pass through with minimal loss, the thickness and relative permittivity of the other liquid crystal layer 12 in the non-controlled state being selected so that radio waves having the frequency $f_2$ cannot pass through.

Furthermore, in Embodiment 4 above, two liquid crystal layers 12 are stacked in the thickness direction, but the stacked liquid crystal layers 12 are not limited to two layers, and there may be three or more layers.

Embodiment 5

Figure 6:
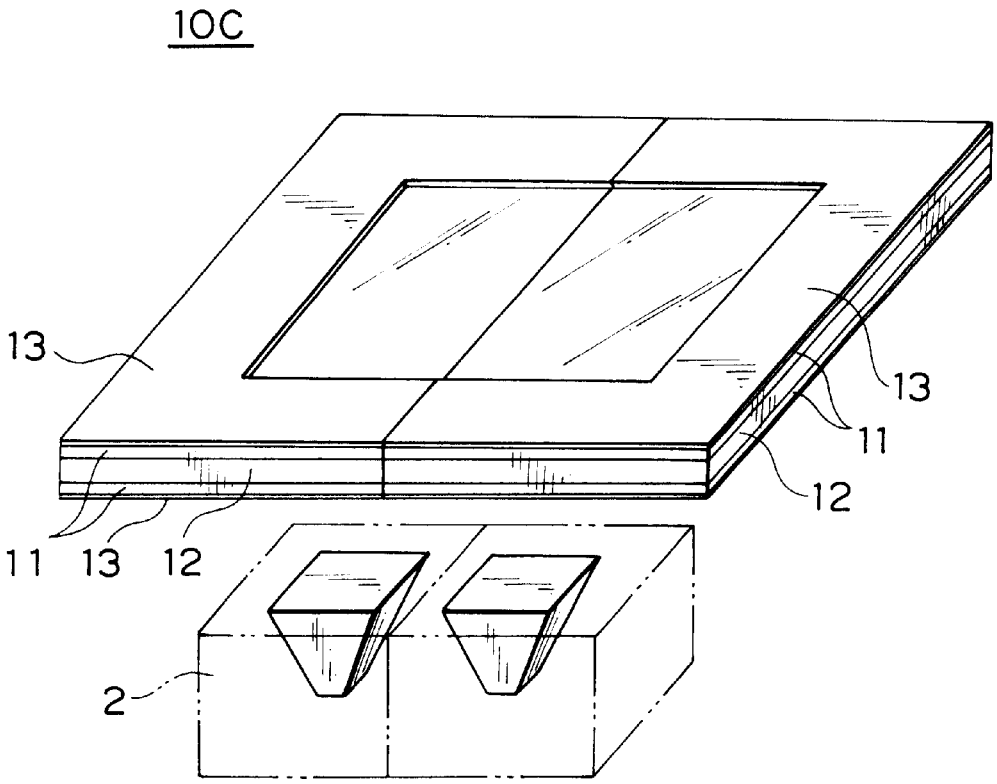
FIG. 6 is a perspective schematically showing a radar assembly employing a radome according to Embodiment 5 of the present invention.
Figure 7:
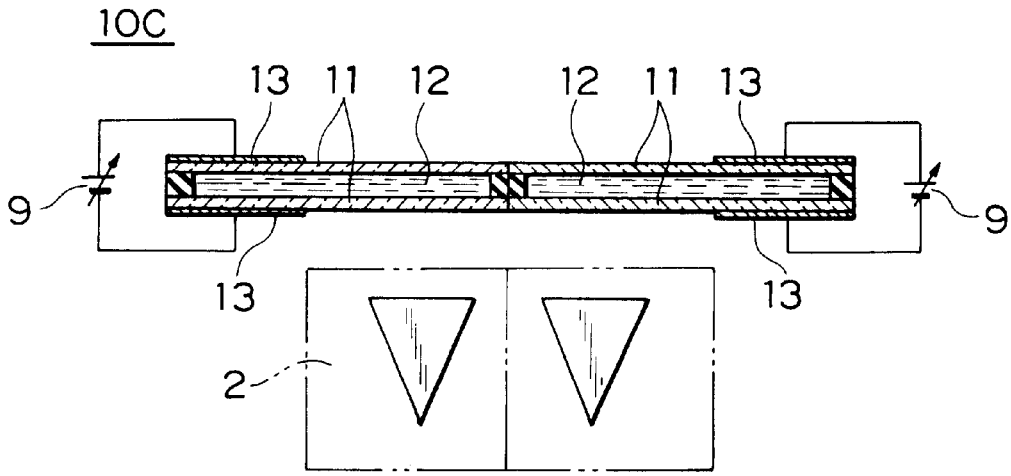
FIG. 7 is a cross section schematically showing a radar assembly employing a radome according to Embodiment 5 of the present invention.

Because a radome 10C according to Embodiment 5 employs a radar antenna 2 composed of separate transmit and receive antennas, two liquid crystal layers 12 are disposed on a plane so as to be positioned above the transmit antenna and the receive antenna, respectively, and two sets of control electrode layers 13 and power sources 9 are disposed to enable electric fields to be applied independently to the two liquid crystal layers 12 as shown in FIGS. 6 and 7. Moreover, the rest of the construction is the same as in Embodiment 1 above.

In Embodiment 5, the relative permittivity and thickness of the two liquid crystal layers 12 are selected so that radio waves having the working frequency of the radar antenna 2 can pass through with minimal loss in the controlled state.

When the radar antenna 2 is transmitting, an electric field is applied to the liquid crystal layer 12 positioned above the transmit antenna of the radar antenna 2, but an electric field is not applied to the liquid crystal layer 12 positioned above the receive antenna. Thus, because external radio waves having the working frequency are reflected by the liquid crystal layer 12 positioned above the receive antenna and are prevented from reaching the receive antenna, interference in the receive antenna due to external radio waves is suppressed.

On the other hand, when the radar antenna 2 is receiving, an electric field is applied to the liquid crystal layer 12 positioned above the receive antenna but an electric field is not applied to the liquid crystal layer 12 positioned above the transmit antenna. Thus, because external radio waves having the working frequency are reflected by the liquid crystal layer 12 positioned above the transmit antenna and are prevented from reaching the transmit antenna, interference in the transmit antenna due to external radio waves is suppressed.

In this manner, according to Embodiment 5, the penetration of radio waves passing through each of the liquid crystal layers 12 positioned above the transmit and receive antennas can be controlled independently. In other words, penetration by external radio waves through the liquid crystal layer 12 above the receive antenna is reduced when the radar antenna 2 is transmitting, and penetration by external radio waves through the liquid crystal layer 12 above the transmit antenna is reduced when the radar antenna 2 is receiving, enabling interference in the radar antenna 2 due to external radio waves to be suppressed.

Moreover, in Embodiment 5 above, the two liquid crystal layers 12 are disposed on the same plane, but it is not necessary for the two liquid crystal layers 12 to disposed in the same plane as each other, and the same effects can be achieved if the two liquid crystal layers 12 are disposed on different planes.

Furthermore, in Embodiment 5 above, two liquid crystal layers 12 are disposed on a plane, but three or more two liquid crystal layers 12 may also be disposed on a plane. In that case, penetration of radio waves can be independently controlled at three or more positions in the plane.

In Embodiment 5 above, the two liquid crystal layers 12 control penetration by radio waves having the same frequency, but the two liquid crystal layers 12 may also control penetration of radio waves having different frequencies. In that case, if the two liquid crystal layers 12 are disposed above two radar antennas 2 each having different working frequencies and the penetration of radio waves having the working frequency of each antenna is controlled, it becomes possible to suppress interference due to external radio waves in the two radar antennas 2.

Furthermore, in Embodiment 5 above, the relative permittivity and thickness of the two liquid crystal layers 12 are selected so that radio waves having the working frequency of the radar antenna 2 can pass through with minimal loss in the controlled state. However, the relative permittivity and thickness of the two liquid crystal layers 12 may also be selected so that radio waves having the working frequency of the radar antenna 2 can pass through with minimal loss in the non-controlled state. Furthermore, the relative permittivity and thickness of one the liquid crystal layers 12 may also be selected so that radio waves having the working frequency of the radar antenna 2 can pass through with minimal loss in the controlled state, the relative permittivity and thickness of the other liquid crystal layer 12 being selected so that radio waves having the working frequency of the radar antenna 2 can pass through with minimal loss in the non-controlled state.

Embodiment 6

Figure 8:
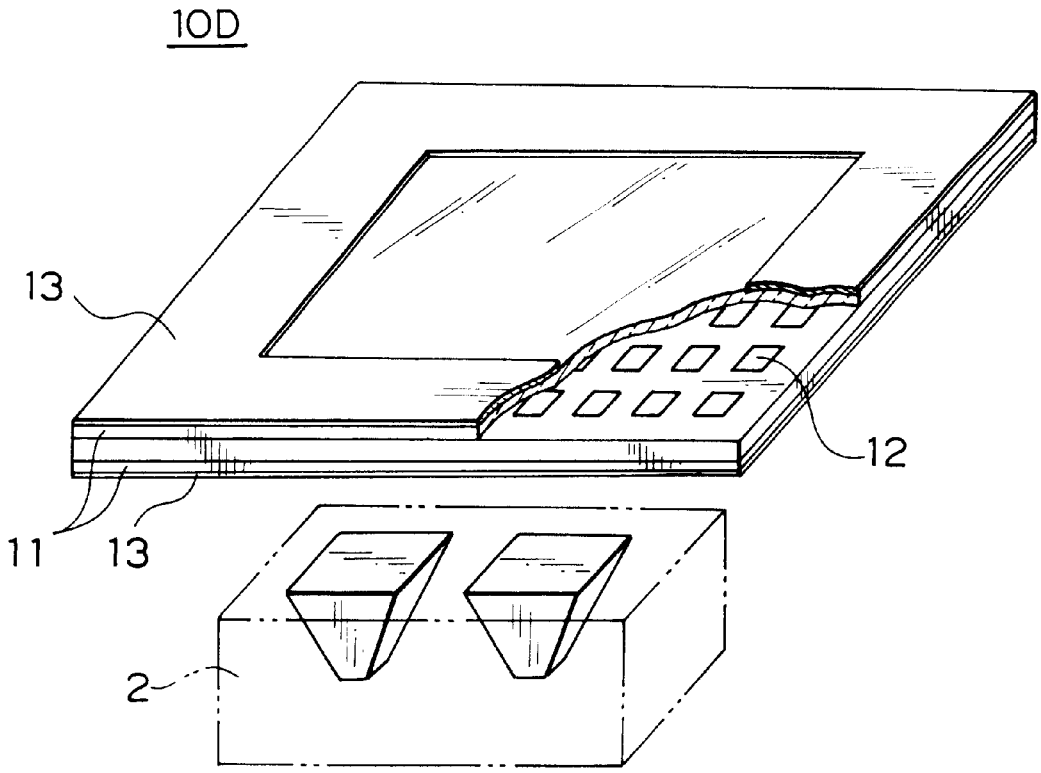
FIG. 8 is a partially-cutaway perspective schematically showing a radar assembly employing a radome according to Embodiment 6 of the present invention.
Figure 9:
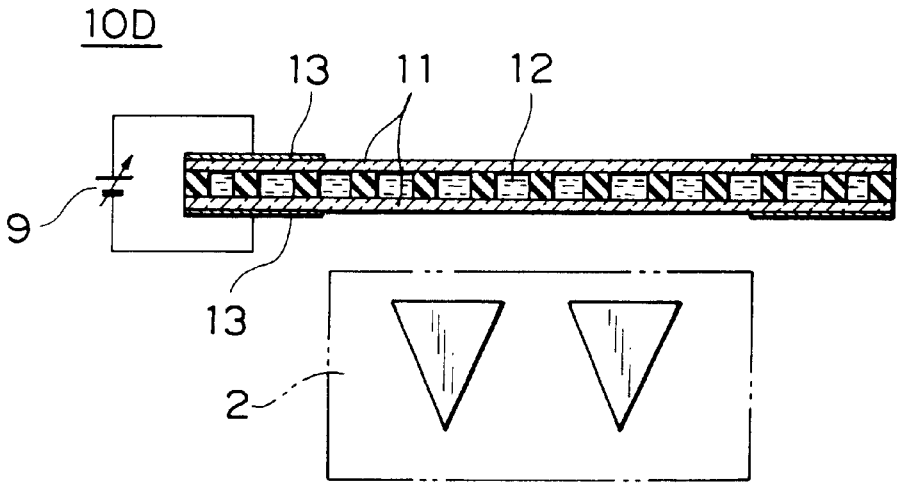
FIG. 9 is a cross section schematically showing a radar assembly employing a radome according to Embodiment 6 of the present invention.

In a radome 10D according to Embodiment 6, the liquid crystal layer 12 is arranged in a matrix shape as shown in FIGS. 8 and 9. Moreover, the rest of the construction is the same as in Embodiment 1 above.

Because the relative permittivity and thickness of the liquid crystal layer 12 are selected so that radio waves having the working frequency of the radar antenna 2 can pass through with minimal loss in the controlled state, the same effects can be achieved by this radome 10D as in Embodiment 1 above.

Furthermore, because the liquid crystal layer 12 in this radome 10D is arranged in a matrix shape, the liquid crystal layer 12 functions as a polarizer. In other words, by selecting the thickness of the liquid crystal layer 12 and the width and period of the matrix appropriately, a polarity changing function can be added to the radome 10D, enabling further reduction of interference acting on the radar antenna 2.

Moreover, in Embodiment 6 above, the liquid crystal layer 12 is arranged in a matrix shape, but the liquid crystal layer may also be arranged in a grid shape. In that case, by selecting the thickness of the liquid crystal layer 12 and the width and period of the grid appropriately, a polarity changing function can be added to the radome, achieving the same effect.

Furthermore, in Embodiment 6 above, the relative permittivity and thickness of the liquid crystal layer 12 are selected so that radio waves having the working frequency of the radar antenna 2 can pass through with minimal loss in the controlled state, but these may also be selected so that radio waves having the working frequency of the radar antenna 2 can pass through with minimal loss in the non-controlled state.

Embodiment 7

In Embodiment 1 above, low-molecular-weight liquid crystals are used in the dielectric layer, but in Embodiment 7, liquid crystalline polymers (LCPs) are used in the dielectric layer.

Figure 10:
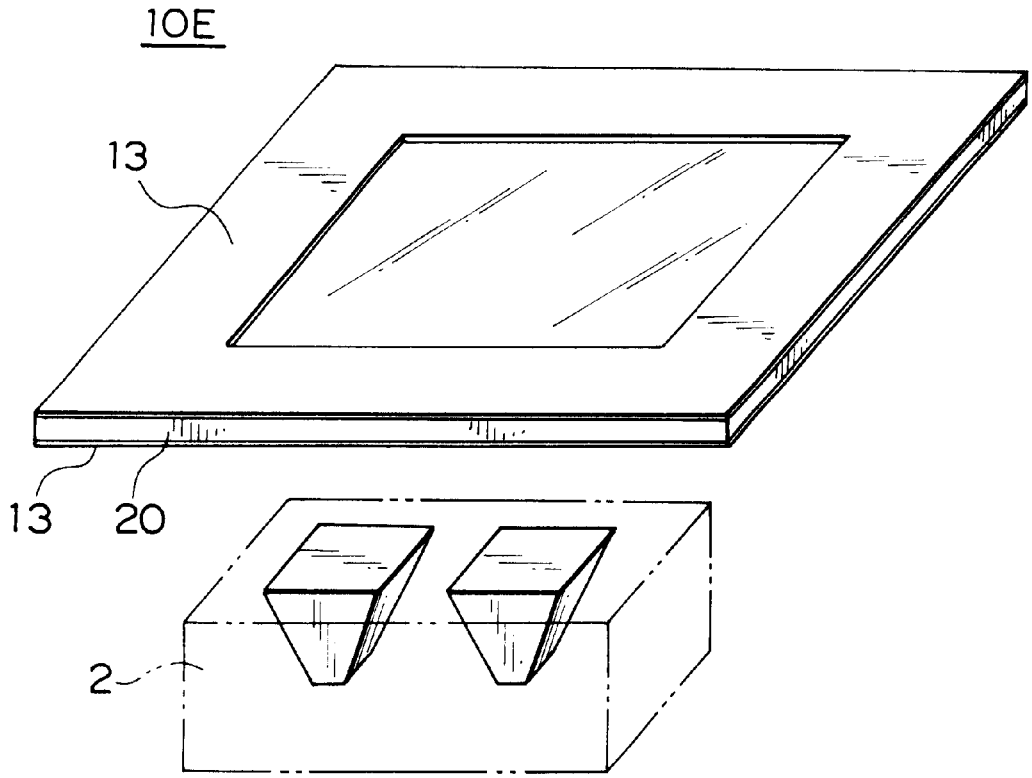
FIG. 10 is a perspective schematically showing a radar assembly employing a radome according to Embodiment 7 of the present invention.
Figure 11:
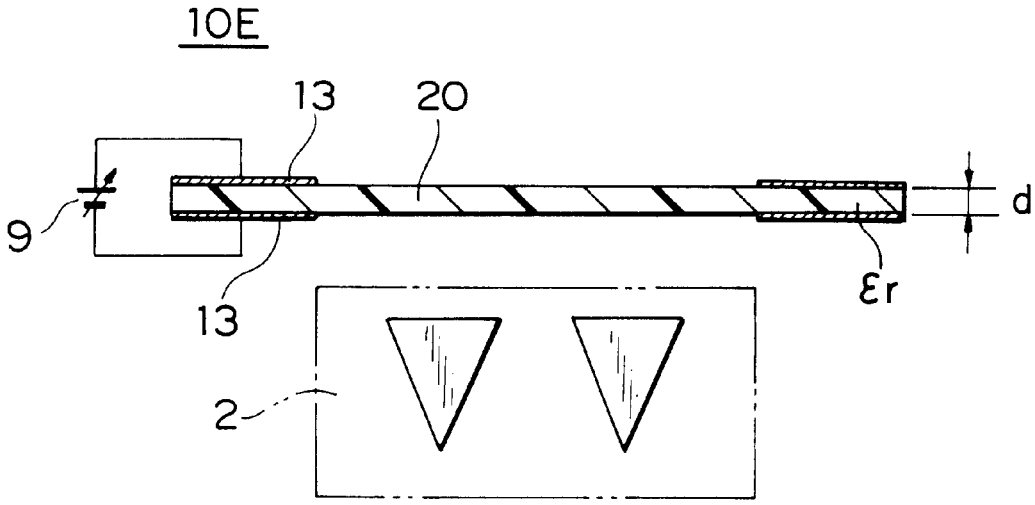
FIG. 11 is a cross section schematically showing a radar assembly employing a radome according to Embodiment 7 of the present invention.
Figure 12:
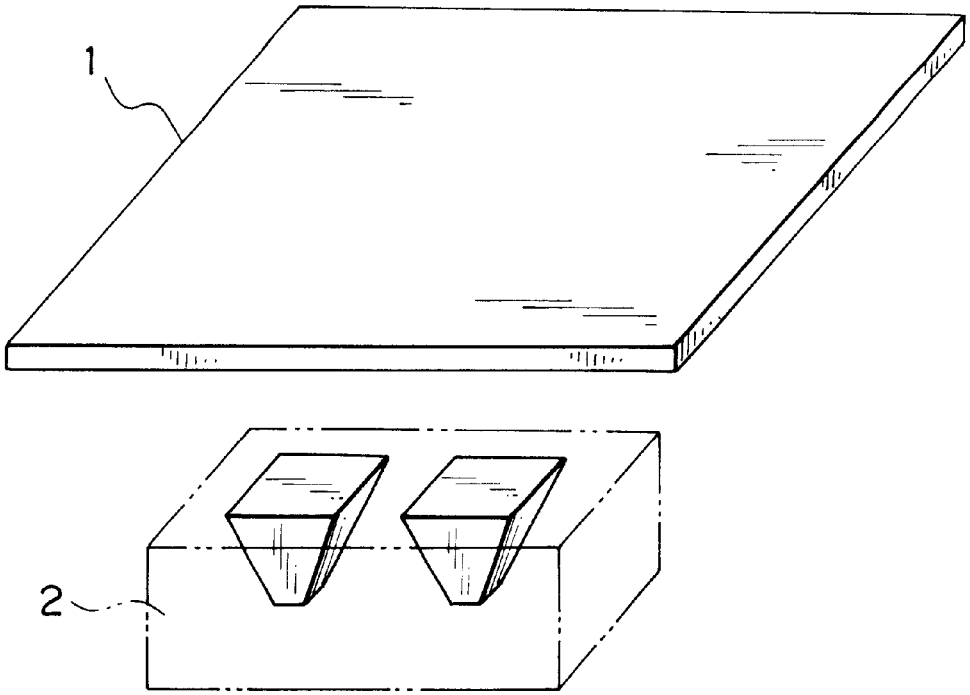
FIG. 12 PRIOR ART
FIG. 12 is a perspective schematically showing a radar assembly employing a conventional radome.
Figure 13:
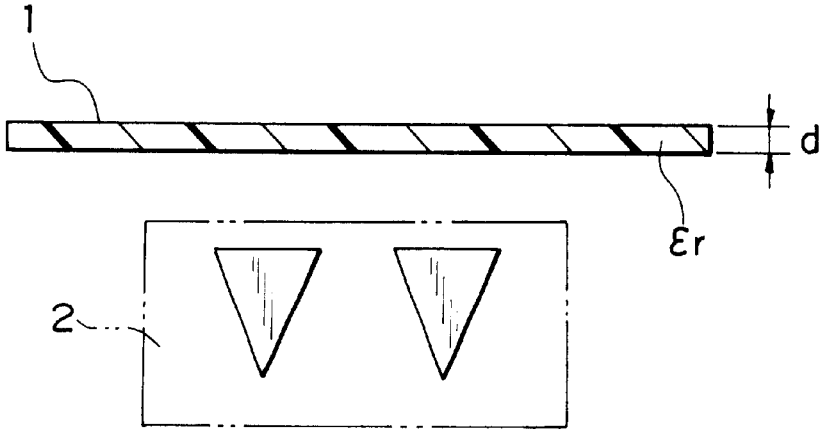
FIG. 13 PRIOR ART
FIG. 13 is a cross section schematically showing a radar assembly employing a conventional radome.

As shown in FIGS. 10 and 11, a radome 10E according to Embodiment 7 includes: a liquid crystal layer 20 composed of liquid crystalline polymers; control electrode layers 13 formed in a frame shape on two surfaces of the liquid crystal layer 20; and a power source 9 for applying an electric field to the liquid crystal layer 20 by means of the control electrode layers 13. The material of the liquid crystal layer 20 is selected such that the relative permittivity of the liquid crystal layer 20 in the controlled state is $\in_{rco}$ and the relative permittivity of the liquid crystal layer 20 in the non-controlled state is $\in_{rnc}$, and the thickness of the liquid crystal layer 20 is selected to satisfy Expression (1) above when in the controlled state ($\in_r=\in_{rco}$). In other words, when the liquid crystal layer 20 is in the controlled state, reflection of radio waves with a free space wavelength $\lambda_0$ is reduced in the radome 10E, permitting radio waves having the frequency used in the radar antenna 2 to pass through with minimal loss.

Because the relative permittivity and thickness of the liquid crystal layer 20 are selected so that radio waves having the working frequency of the radar antenna 2 can pass through with minimal loss in the controlled state, the same effects can be achieved by this radome 10E as in Embodiment 1 above.

Furthermore, because the liquid crystal layer 20 in this radome 10E is composed of liquid crystalline polymers, glass plates 11 are not required, thereby increasing design freedom, reducing the number of component parts, improving productivity, and enabling costs to be lowered compared to Embodiment 1.

Now, the liquid crystal layer 20 in Embodiment 7 above replaces the liquid crystal layer 12 in the radome of Embodiment 1, but naturally the same effects can be achieved by applying the liquid crystal layer 20 to the radomes of any of Embodiments 2 to 6.

Moreover, each of the above embodiments has been explained using a radar antenna 2 as an example of a radar device, but the radar device is not limited to a radar antenna and may be any transceiver device.

In each of the above embodiments, metal electrodes such as copper are used for the control electrode layers 13, but the control electrode layers 13 are not limited to metal electrodes and may be any conducting material such as tin oxide ($SnO_2$) or indium oxide ($In_2O_3$), for example.

Furthermore, in each of the above embodiments, metal electrodes which reflect and absorb radio waves are used for the control electrode layers 13 and it is necessary to form the control electrode layers 13 into frame or grid shapes to ensure a penetration zone for radio waves, but if a material which does not reflect or absorb radio waves is used, the control electrode layer can be formed over an entire surface of the glass plates 11 or the liquid crystal layer 20. In that case, because the electric field can be applied uniformly to the liquid crystal layers 12 or 20, the penetration of radio waves can be made uniform over the entire region of the liquid crystal layers 12 or 20.

In each of the above embodiments, radomes 10 to 10E are formed in a flat plate shape, but the radomes 10 to 10E are not limited a flat plate shape and may also be formed in a curved shape appropriate to the mounted position of the radome.

Furthermore, in each of Embodiments 1 to 6, the liquid crystal layer 12 is held between a pair of glass plates 11, but the same effects can be achieved if plastic plate or plastic film is used instead of glass plate 11.

The present invention is constructed in the above manner and exhibits the effects described below.

According to one aspect of the present invention, there is provided a radome which has a dielectric layer whose relative permittivity is changed by the application of an electric field, and an electric field applying means for applying the electric field to the dielectric layer, enabling penetration by radio waves obtained from the free space wavelength of the radio waves used with the dielectric layer to be changed by controlling the application of an electric field and changing the relative permittivity of the dielectric layer, thereby providing a radome enabling interference due to external radio waves having a frequency the same as the working frequency of a radar device to be reduced when the radar device is not being used.

The dielectric layer may also include a liquid crystal layer, enabling the relative permittivity of the dielectric layer to be easily changed by controlling application of the electric field.

A number of liquid crystal layers may also be stacked in a thickness direction, enabling the radio wave penetration to be precisely controlled.

A number of liquid crystal layers may also be disposed on a plane, thereby dividing the zone of radio wave penetration and enabling the radio wave penetration of each zone division to be controlled separately.

The liquid crystal layer may also be constructed in a grid shape or in a matrix shape, adding a polarity changing function to the radome and enabling interference in the radar device to be further suppressed.

The thickness and relative permittivity of the dielectric layer may also be set such that radio waves having a specific frequency pass through when the electric field is being applied, enabling interference due to external radio waves having a frequency the same as the working frequency of the radar device to be reduced when the dielectric layer is in a noncontrolled state.

The thickness and relative permittivity of the dielectric layer may also be set such that radio waves having a specific frequency pass through when the electric field is not being applied, enabling interference due to external radio waves having a frequency the same as the working frequency of the radar device to be reduced when the dielectric layer is in a controlled state.

What is claimed is:

1. A radome comprising:

a dielectric layer whose relative permittivity is changed by the application of an electric field; and an electric field applying means for applying said electric field to said dielectric layer; wherein said dielectric layer is a liquid crystal layer.

2. The radome according to claim 1 wherein thickness and relative permittivity of said dielectric layer are set such that radio waves having a specific frequency pass through said dielectric layer when said electric field is being applied.

3. The radome according to claim 1 wherein thickness and relative permittivity of said dielectric layer are set such that radio waves having a specific frequency pass through said dielectric layer when said electric field is not being applied.

4. The radome according to claim 1 wherein a number of said liquid crystal layers are stacked in a thickness direction.

5. The radome according to claim 1 wherein a number of said liquid crystal layers are disposed on a plane.

6. The radome according to claim 1 wherein said liquid crystal layers are constructed in a grid shape or in a matrix shape.

7. The radome according to claim 1 wherein thickness and relative permittivity of said dielectric layer are set such that radio waves having a specific frequency pass through said dielectric layer when said electric field is being applied.

8. The radome according to claim 1 wherein thickness and relative permittivity of said dielectric layer are set such that radio waves having a specific frequency pass through said dielectric layer when said electric field is not being applied.

* * * * *